US006945199B2

(12) United States Patent
Kapala et al.

(10) Patent No.: US 6,945,199 B2
(45) Date of Patent: Sep. 20, 2005

(54) ENGINE COOLANT CROSSOVER ASSEMBLY

(75) Inventors: David T. Kapala, Shelby Township, MI (US); Michael E. Dunn, Canton, MI (US); Marcello Tedesco, Saline, MI (US); John S. Frait, Ann Arbor, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 10/670,768

(22) Filed: Sep. 24, 2003

(65) Prior Publication Data

US 2005/0061266 A1 Mar. 24, 2005

(51) Int. Cl.[7] ..... F01P 9/00
(52) U.S. Cl. ..... 123/41.01; 123/184.21
(58) Field of Search ..... 123/41.55, 545, 123/546, 547, 41.01, 184.21

(56) References Cited

U.S. PATENT DOCUMENTS

| | | | | |
|---|---|---|---|---|
| 3,831,566 A | | 8/1974 | Thomas | |
| 3,931,811 A | * | 1/1976 | McFarland, Jr. | 123/184.34 |
| 4,072,133 A | | 2/1978 | McWhirter | |
| 4,279,224 A | | 7/1981 | Szabo et al. | |
| 4,522,248 A | | 6/1985 | Friesen | |
| 4,872,424 A | | 10/1989 | Carnes | |
| 5,063,987 A | | 11/1991 | Weimann | |
| 5,503,118 A | | 4/1996 | Hollis | |
| 5,666,930 A | | 9/1997 | Elder | |
| 5,988,148 A | | 11/1999 | Astner et al. | |
| 6,435,157 B1 | | 8/2002 | Zaremba et al. | |
| 2002/0005183 A1 | | 1/2002 | Cardno et al. | |

FOREIGN PATENT DOCUMENTS

| | | |
|---|---|---|
| WO | 01/12962 | 2/2001 |

* cited by examiner

*Primary Examiner*—Noah P. Kamen
(74) *Attorney, Agent, or Firm*—MacMillan, Sobanski & Todd, LLC

(57) ABSTRACT

The present invention relates to a coolant crossover member and intake manifold assembly adapted for use in a vehicle engine and method for producing the same. The crossover and manifold assembly includes crossover and a manifold. The crossover has a passage formed therein extending between a first end and a second end thereof. The manifold is joined to the first and second ends of the crossover. The manifold is provided with first and second openings which define first and second inner surfaces, respectively. According to the present invention, at least one of the first end and the second end of the crossover is disposed within one of the first and the second openings of the manifold such that the at least one of the first end and the second end of the crossover completely covers the one of the first and the second inner surfaces of the one of the first and the second openings thereby preventing fluid from contacting the one of the first and second inner surfaces of the one of the first and second openings of the manifold.

28 Claims, 7 Drawing Sheets

ENGINE COOLANT CROSSOVER ASSEMBLY

BACKGROUND OF THE INVENTION

This invention relates in general to vehicle engines and in particular to an improved coolant crossover member and intake manifold assembly for use in such a vehicle engine and a method for producing the same.

Coolant crossovers, commonly used on a V-type internal combustion engine, are well known and have been used for many years. Such coolant crossovers carry the engine coolant from one bank or side of the engine to the opposite bank as part of the engine coolant circuit. Commonly, a separate or stand-alone coolant crossover is usually attached to an intake manifold by a plurality of threaded fasteners, such as bolts.

One example of a coolant crossover is disclosed in PCT Application No. WO 01/12962 A1 to Boyd et. al. In this application, the coolant crossover is a stand-alone part mounted to opposite cylinder heads of a V-type engine.

SUMMARY OF THE INVENTION

The present invention relates to a coolant crossover member and intake manifold assembly adapted for use in a vehicle engine and method for producing the same.

The crossover and manifold assembly includes crossover and a manifold. The crossover has a passage formed therein extending between a first end and a second end thereof. The manifold is joined to the first and second ends of the crossover. The manifold is provided with first and second openings which define first and second inner surfaces, respectively. According to the present invention, at least one of the first end and the second end of the crossover is disposed within one of the first and the second openings of the manifold such that the at least one of the first end and the second end of the crossover completely covers the one of the first and the second inner surfaces of the one of the first and the second openings thereby preventing fluid from contacting the one of the first and second inner surfaces of the one of the first and second openings of the manifold.

Other advantages of this invention will become apparent to those skilled in the art from the following detailed description of the invention, when read in light of the accompanying drawings.

DETAILED DESCRIPTION OF THE INVENTION

Figure 1:
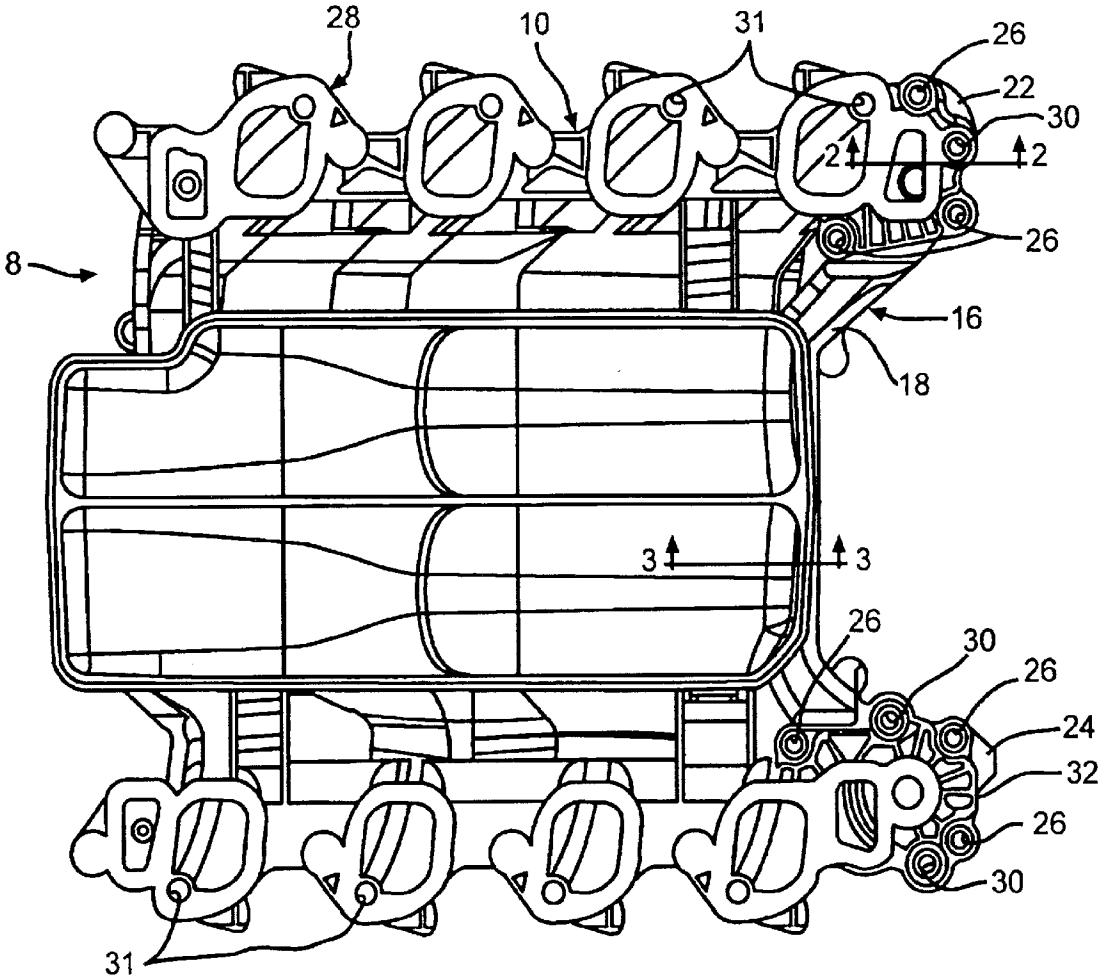
FIG. 1 (PRIOR ART)
FIG. 1 is a plan view of a portion of a prior art vehicle engine interface including a fluid crossover and manifold assembly.

Referring now to the drawings, there is illustrated in prior art FIG. 1 a portion of vehicle engine, indicated generally at 8, including a prior art coolant crossover and intake manifold assembly, indicated generally at 10. The general structure and operation of the prior art coolant crossover and intake manifold assembly 10 is conventional in the art. Thus, only those portions of the prior art coolant crossover and intake manifold assembly 10 which are necessary for a full understanding of this invention will be explained and illustrated in detail.

Figure 2:
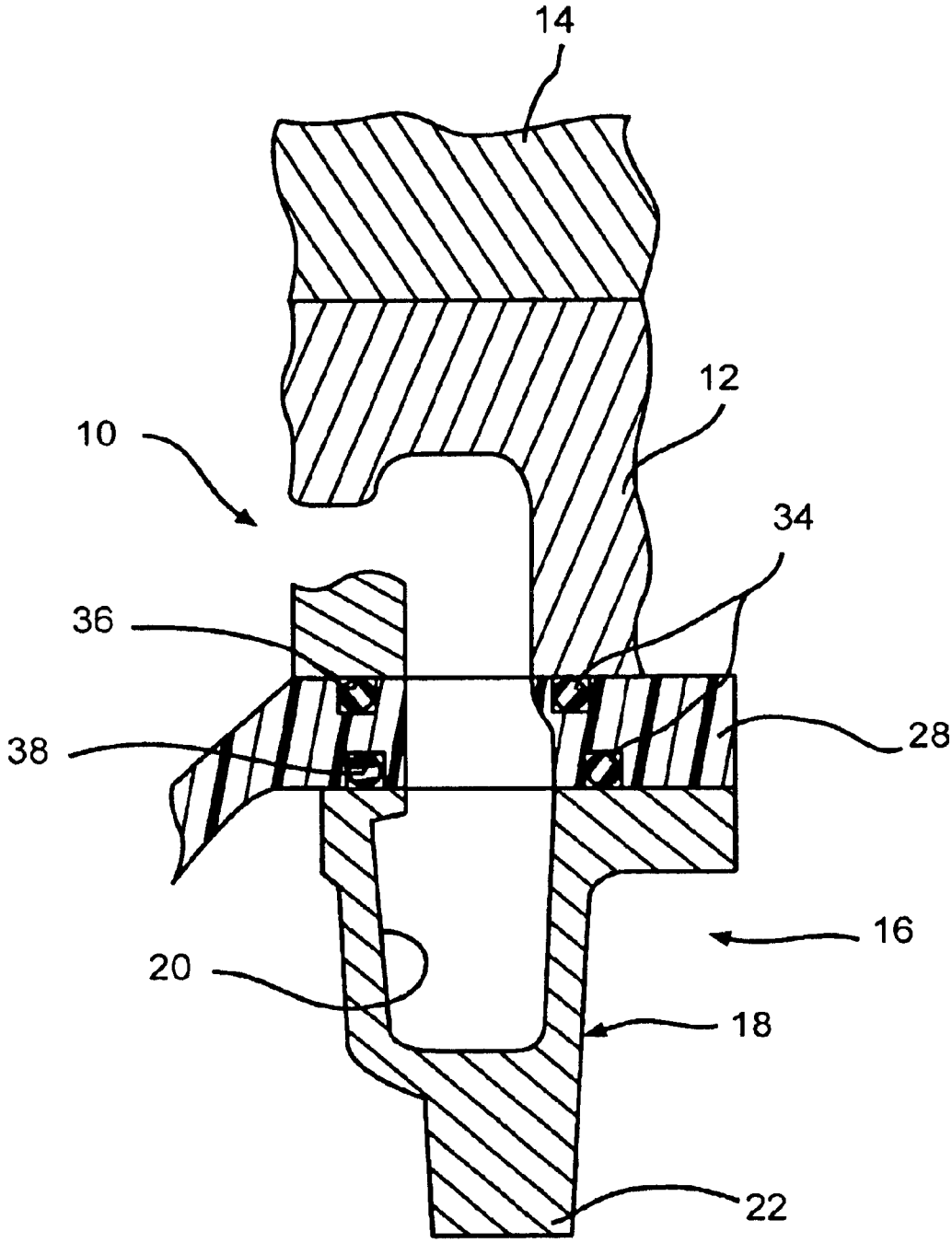
FIG. 2 (PRIOR ART)
FIG. 2 is an enlarged sectional view taken along line 2—2 of prior art FIG. 1.
Figure 3:
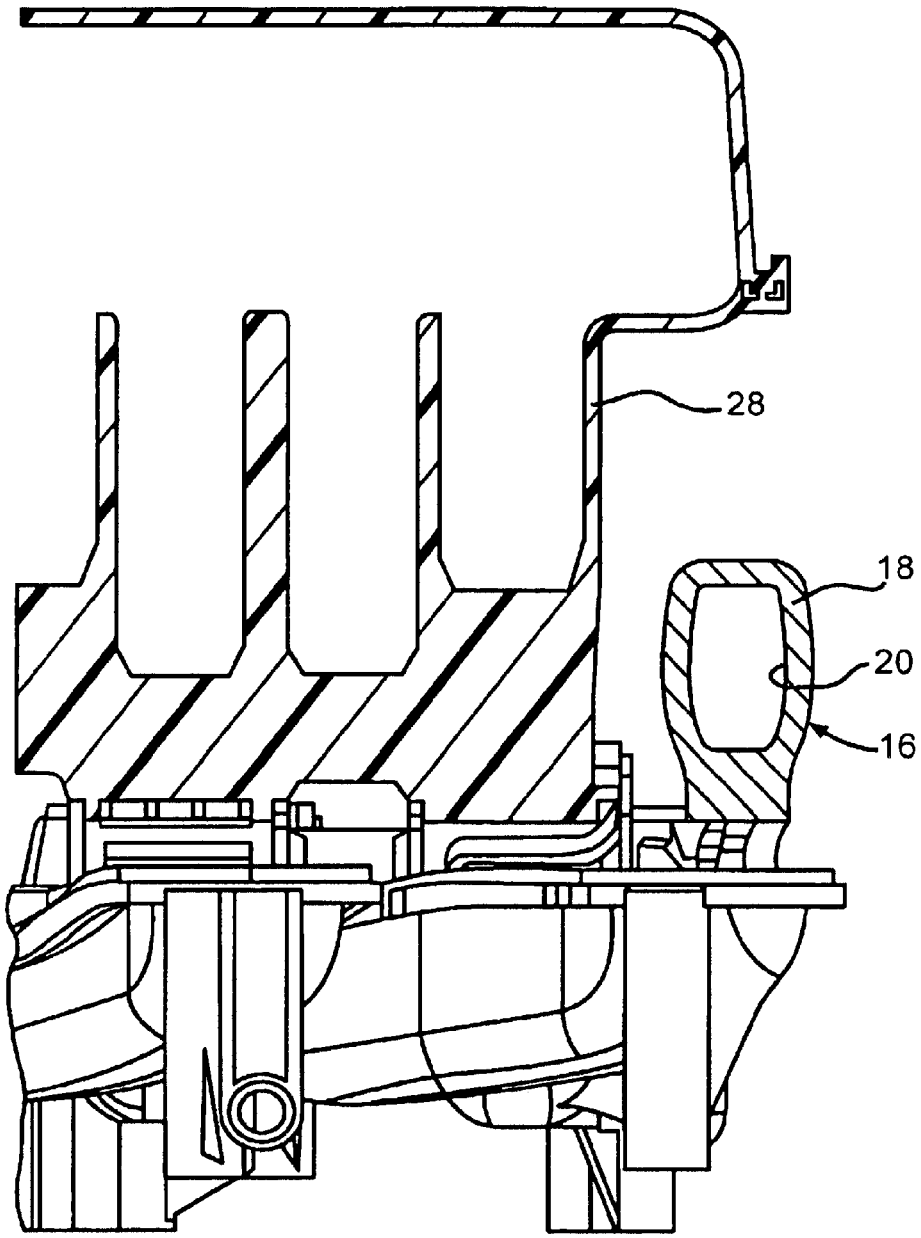
FIG. 3 (PRIOR ART)
FIG. 3 is an enlarged sectional view taken along line 3—3 of prior art FIG. 1.

The prior art coolant crossover and intake manifold assembly 10 shown is for use with a V-8 type internal combustion engine, portions of which are shown in prior art FIGS. 2 and 3. The assembly 10 is intended for mounting on cylinder heads 12 of an engine block 14, a portion of which is shown in prior art FIG. 2. The prior art assembly 10 includes a crossover 16 having a fluid conduit or crossover body 18. The body 18 defines a passage 20, best shown in prior art FIG. 3, extending between a first end 22 and a second end 24 of the body 18. Typically, the prior art crossover 16 is formed from cast aluminum. Alternatively, the prior crossover 16 can be formed from other materials, such as for example, other metals and non-metals.

The first and second ends 22 and 24 of the crossover body 18 each include a plurality of first apertures 26. Suitable fasteners (not shown) extend through the first apertures 26 of the body 18 and are threadably received in an intake manifold 28 in a known manner for attaching the prior art crossover 16 to the manifold 28. The intake manifold 28 is commonly formed from a polymer material, such as nylon. The first and second ends 22 and 24 of the crossover body 18 each include one or more second apertures 30. Suitable fasteners (not shown) extend through the second apertures 30 of the body 18 and also through associated apertures (not shown) formed in the intake manifold 28 and are threadably received in the cylinder heads 12 in a known manner for attaching the crossover 16 and intake manifold assembly 10 to the cylinder heads 12. Typically, the fasteners are threaded fasteners, however any desired type of fastener can be used. Suitable fasteners (not shown) also extend through third apertures 31 of the manifold 28 and are threadably received in the cylinder heads 12 in a known manner for attaching the prior art manifold 28 to the cylinder heads 12.

In the prior art coolant crossover and intake manifold assembly 10 illustrated in prior art FIGS. 1 through 3, the crossover body 18 includes a thermostat well 32 for receiving a thermostat (not shown). As best shown in prior art FIG. 2, a pair of fluid sealing means 34, such as O-rings or gaskets, are disposed in grooves 36 and 38 provided in the manifold 28. The gaskets 34 are effective to provide a fluid-tight seal between the crossover 16 and the manifold 28 and between the manifold 28 and the cylinder heads 12, to prevent fluid from leaking therebetween.

As can be understood, the illustrated prior art coolant crossover and intake manifold assembly 10 requires at least two separate gaskets 34 at each of its ends, and a plurality of fasteners (not shown, but at least five such fasteners would be required), which extend through the apertures 26 to attach the crossover 16 to the manifold 28. As discussed above, coolant crossovers can also be formed of a polymer, such as nylon. Further, a commonly used vehicle anti-freeze or coolant can comprise a glycol-based fluid, such as ethylene glycol. Such a coolant can chemically degrade a manifold 28 formed from a polymer such that the polymer material thereof is caused to dissolve, thereby degrading performance of the vehicular cooling. The structure and method for producing the prior art crossover and manifold assembly 10 thus far described and illustrated is conventional in the art.

Figure 4:
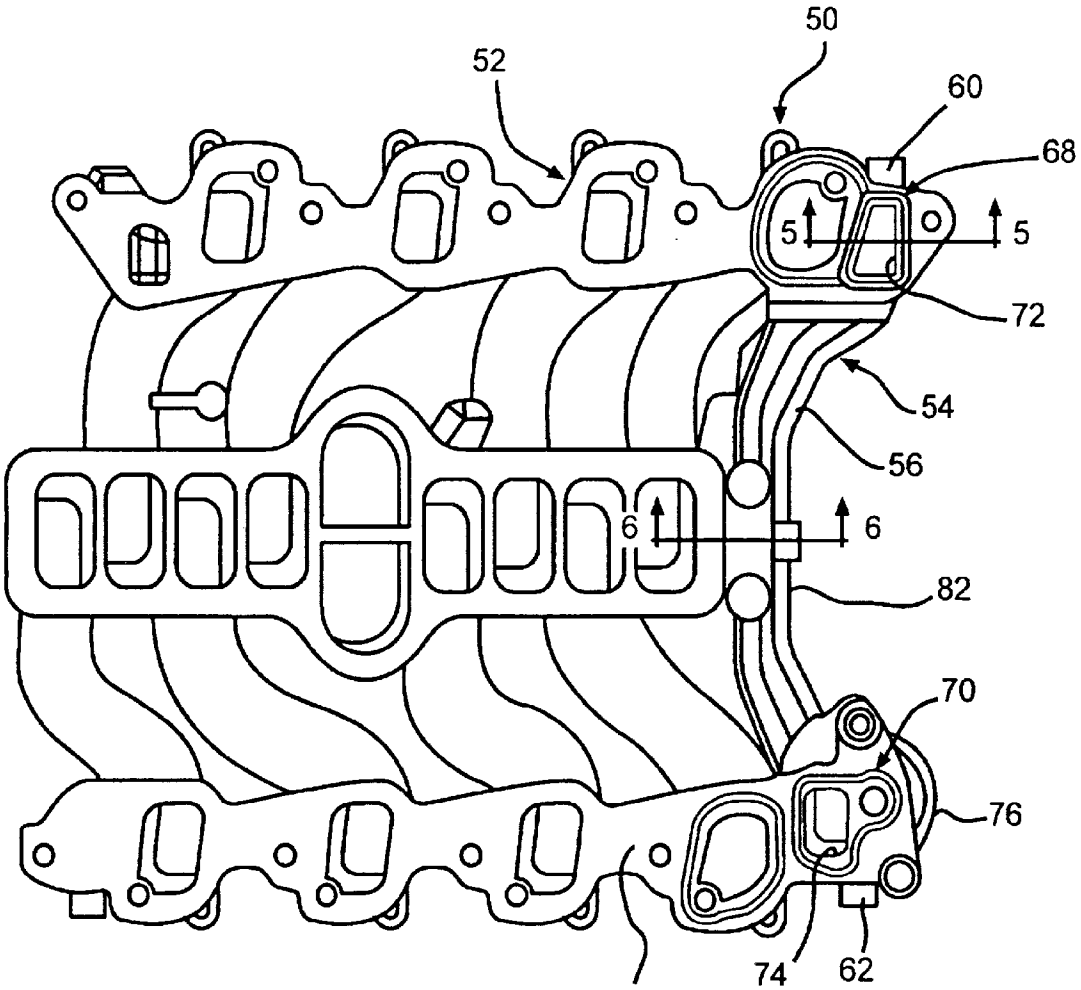
FIG. 4 is a plan view of a portion of a vehicle engine interface including a first embodiment of a fluid crossover and manifold assembly constructed in accordance with the present invention.
Figure 5:
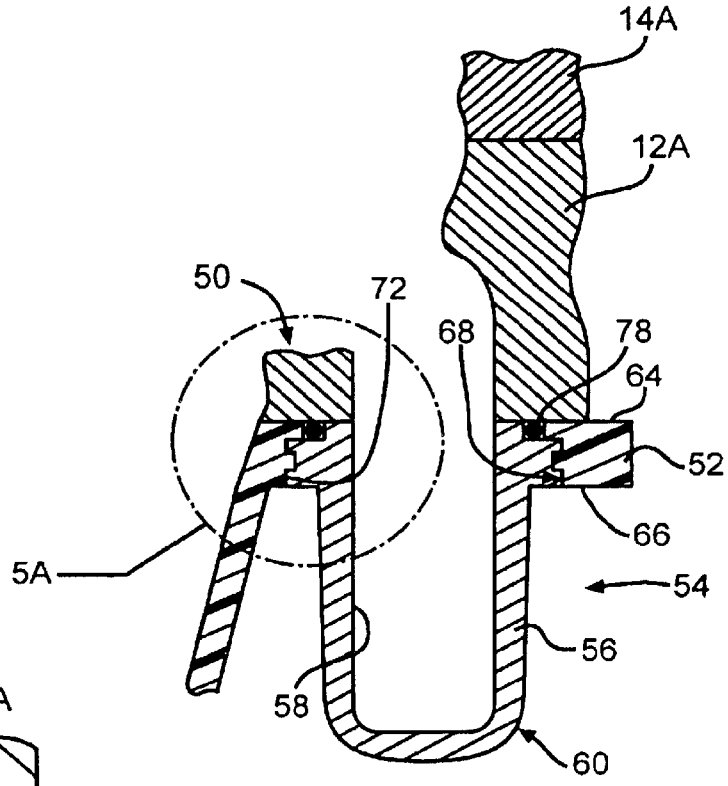
FIG. 5 is an enlarged sectional view taken along line 5—5 of FIG. 4.
Figure 6:
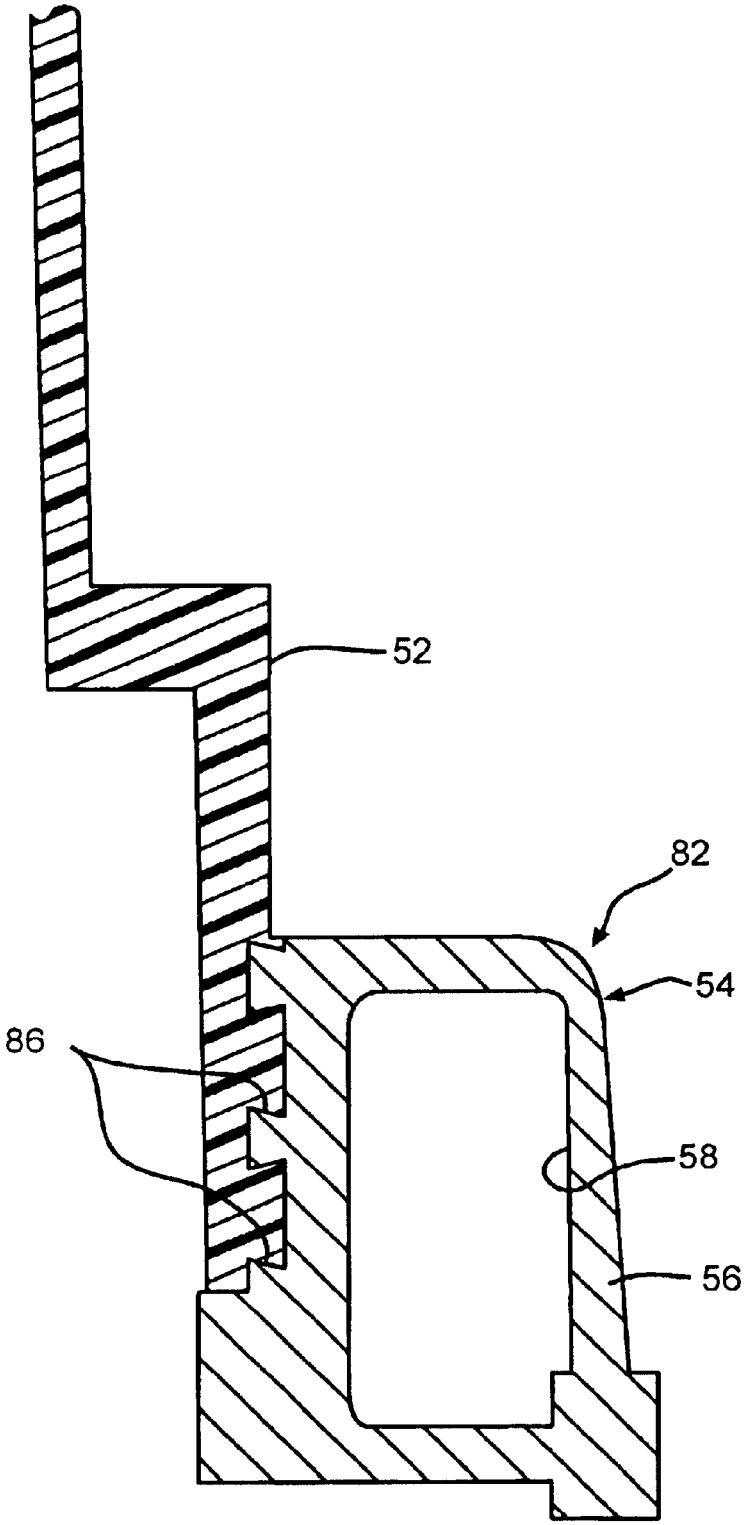
FIG. 6 is an enlarged sectional view taken along line 6—6 of FIG. 4.

Referring now to FIGS. 4 through 6, there is illustrated a first embodiment of a coolant crossover and intake manifold assembly, indicated generally at 50, in accordance with the present invention. In the illustrated coolant crossover and intake manifold assembly 50, the assembly is preferably "overmolded", such that that a plurality of fasteners, and at least one pair of gaskets is eliminated from the assembly 50 compared to the prior art assembly 10.

The illustrated coolant crossover and intake manifold assembly 50 shown in FIG. 4 is for use with a V-8 type style internal combustion engine (only a portion of which is illustrated). Alternatively, the coolant crossover and intake manifold assembly 50 of the present invention can be used with other types of engines if so desired. The assembly 50 is intended for mounting on cylinder heads 12A of an engine block 14A, a portion of which is shown in FIG. 5. The coolant crossover and intake manifold assembly 50 includes an intake manifold 52 and a crossover 54. In the illustrated embodiment, the manifold 52 is preferably formed from a polymer, such as for example nylon, and the crossover 54 is formed from a metal, such as for example aluminum. Alternatively, the manifold 52 and/or the crossover 54 can be formed from other materials if so desired, such as other metals and non-metals.

The crossover 54 has a fluid conduit or crossover body 56. The body 56 defines a passage 58, shown in FIG. 6, extending between a first end 60 and a second end 62 of the body 56.

Referring to FIGS. 4 and 5, the manifold 52 includes an upper surface 64, an opposite lower surface 66, and a pair of openings 68 and 70 extending therethrough. The openings 68 and 70 define inner surfaces 72 and 74, respectively. In the illustrated embodiment, the inner surfaces 72 and 74 have a stepped or varying configuration. As shown in FIG. 4, the first end 60 and the second end 62 of the crossover body 56 are respectively disposed within the first and the second openings 68 and 70 of the manifold 52 for a purpose to be discussed below.

As best shown in FIG. 5, the first end 60 of the crossover body 56 extends through the first opening 68 of the manifold 52 so as to completely cover or encircle the entire first inner surface 72 of the opening 68 of the manifold 52. As a result of this, fluid can therefore be conducted through the passage 58 of the conduit body 56 of crossover 16 such that the fluid does not contact any portion of the manifold 52 at a joint or connection with the first end 60 of the crossover 54.

Figure 5A:
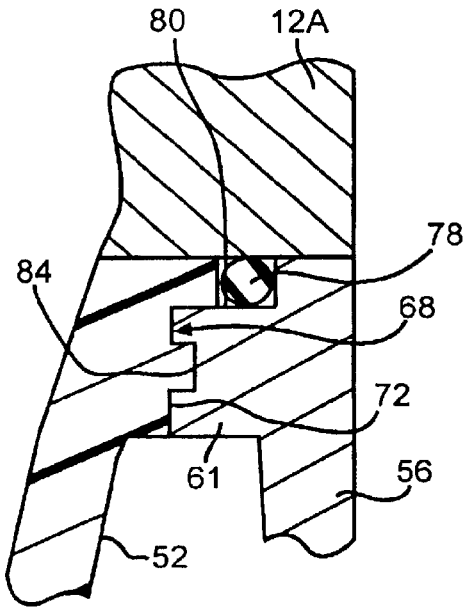
FIG. 5A is an enlarged sectional view of a portion of the fluid crossover illustrated in FIG. 5.

As best shown in FIG. 5A, the first end 60 of the crossover 54 includes a circumferentially, outwardly extending flange 61 defining a seal recess 80. A circumferentially inwardly extending recess 84, the purpose of which will be explained below, is formed in an outer surface of the flange 61. Although not shown in detail, the structure of the joint or connection of the second end 62 of the crossover 54, with respect to the second opening 70 of the manifold 52, is similar to that of the first end 60 of the crossover 54.

Although the embodiment of the coolant crossover and intake manifold assembly 50 illustrated in FIG. 4 shows both the first and second ends 60 and 62 of the crossover 54 disposed within the first and second openings 68 and 70, such is not required. For example, if desired only one of the first and second ends 60 and 62 can be disposed within a desired opening of the manifold 52.

In the illustrated embodiment of the assembly 50, the crossover body 56 includes a thermostat well 76 for receiving a thermostat (not shown). Fluid sealing means 78, such as an O-ring or a gasket, is disposed in the seal recess 80 provided in the crossover 54. The gasket 78 is effective to provide a fluid tight seal between the first end 60 of the crossover 54 and the cylinder head 12A to prevent fluid from leaking therebetween. Further, fluid can flow through the crossover 54 to the opposed sides of the engine without contacting any portion of the manifold 52, thereby reducing or preventing polymer dissolution which can occur when known engine coolants contact the intake manifold material as discussed above in connection with the prior art crossover and manifold assembly 10.

In the illustrated embodiment, the crossover 54 is preferably made of a relatively rigid material. More preferably, the crossover 54 is formed of a metal, such as aluminum. Most preferably, the crossover 54 is formed of cast aluminum, such as aluminum 319. Alternately, the crossover 54 can be formed from other materials, such as, for example, other metals, alloys thereof and non-metals. It will be appreciated also that the crossover 54 can be formed of any other desired method, such as, for example, by casting or hydro-forming.

Preferably, the manifold 52 is made of a plastic or polymer material capable of being formed by a molding process. More preferably, the manifold 52 is made of nylon, such as nylon 6 or nylon 6/6. However, it will be appreciated that the manifold 52 can be formed of any other desired material, such as, for example, aluminum or alloys thereof. Alternately, the manifold 52 can be formed from other materials, such as, for example, other metals and non-metals.

In the illustrated embodiment, the manifold 52 is secured or joined to selected portions of the crossover 54, such as the first and second ends 60 and 62 and a central portion 82. Alternately, the central portion 82 could be secured to the manifold 52 by other methods if so desired. The manifold 52 can be secured to the crossover 54 by any desired method. Preferably, as will be discussed, in the illustrated embodiment the manifold 52 is permanently secured to the crossover 54 by mechanically joining the components together during an insitu molding process to thereby form an "overmolded" coolant crossover and intake manifold assembly 50. As used herein, the term overmolded defines an assembly wherein the crossover 54 is permanently connected or jointed to the manifold 52 during the molding process to form an integrally joined assembly. Preferably, such a molding process would involve molding or forming a plastic manifold about a preformed metal (or non-metal) crossover.

Figure 7:
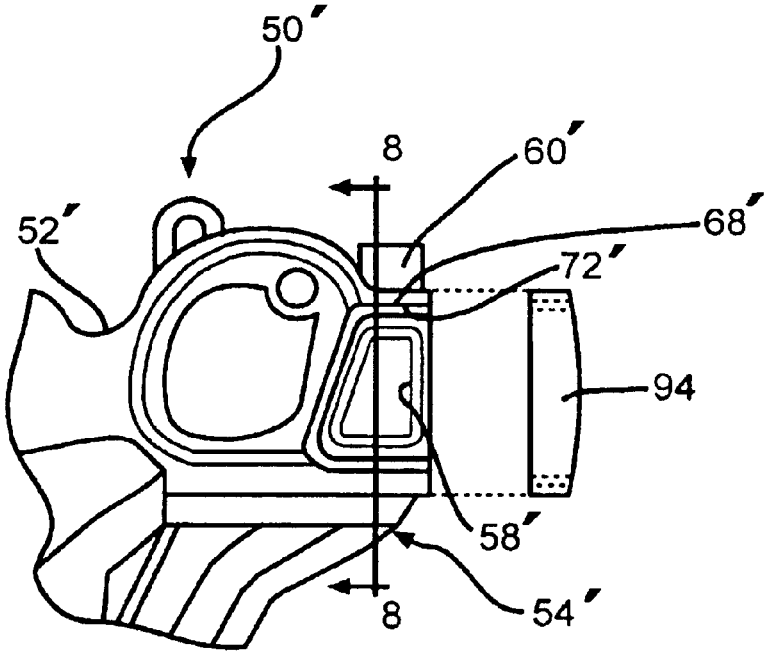
FIG. 7 is a plan view of a portion of a vehicle engine including a second embodiment of the fluid crossover and manifold assembly constructed in accordance with the present invention.
Figure 8:
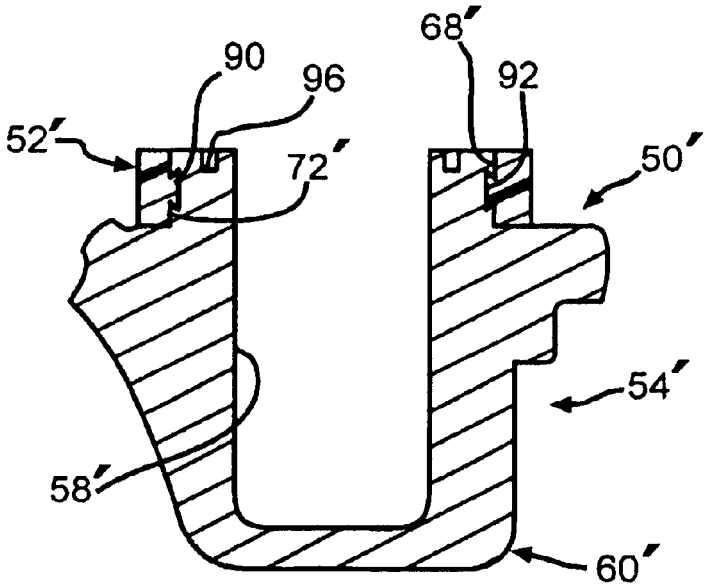
FIG. 8 is an enlarged sectional view taken along line 8—8 of FIG. 7.

In such a molding process, the crossover 54 is preferably placed within a portion of a mold cavity of a mold (not shown). Manifold material, such as a polymer melt, is then introduced into the mold cavity such that the polymer melt is in contact with the crossover 54. It will be appreciated that the entire crossover 54 can be placed into the mold, or only the selected portions of the crossover 54 to be bonded, such as the first and second ends 60 and 62, and the central portion 82, can be placed into the mold. It will be further appreciated that the manifold 52 can be bonded to the crossover 54 by any other desired method, such as with an adhesive (not shown) or as illustrated in FIGS. 7 and 8 and described below.

Preferably, the polymer of the manifold 52 becomes mechanically joined to the crossover 54 during the molding process to form the crossover and intake manifold assembly 50. To accomplish this, features such as the recesses 84, as shown in FIG. 5, dovetail grooves 86, as shown in FIG. 6, protrusions (not shown), and combinations of recesses and protrusions, can be provided on the crossover 54, such that the molten manifold material fills the recesses 84 and grooves 86 during the molding process. The manifold material thereby becomes mechanically locked or joined to the crossover 54 when the manifold material hardens within the recesses 84 and grooves 86. It will be appreciated that the recesses and/or the protrusions can be of any desired shape, such as ring-shaped or cylindrically shaped.

Alternately, the manifold 52 can be permanently secured to the crossover 54 by mechanically joining the two components together during an insitu casting process, wherein, for example the manifold 52 is cast about a portion of the crossover 54 to secure the manifold 52 to the crossover 54. Preferably, such a casting process would involve casting or forming a metal manifold about a preformed metal (or non-metal) crossover.

It will be also appreciated that the crossover body 56 can also have mounted thereto components such as, for example, a bracket (not shown), an exhaust gas recirculation (EGR) valve (not shown), a coolant temperature sensor (not shown), and the like.

In use, the crossover 54 is preferably mounted between opposite cylinder heads, or other members, of a V-8 type engine. The first end 60 of the crossover body 56 is preferably connected with a coolant passage in one cylinder head and the second end 62 of the body 56 is preferably connected with a coolant passage in the other cylinder head.

The exemplary embodiment of the crossover and intake manifold assembly 50 illustrated in FIGS. 4 through 6 has been described in the context of an overmolded assembly. However, it will be appreciated that the assembly 50 can be manufactured by any desired method wherein the manifold 52 is joined to the crossover 54. Additionally, the crossover 54 can be attached to the manifold 52 by any other desired method. For example, FIGS. 7 and 8 show an alternate embodiment of a portion of a second embodiment of a crossover and intake manifold assembly, indicated generally at 50', and constructed in accordance with the present invention.

As shown in the embodiment illustrated in FIGS. 7 and 8, the crossover and intake manifold assembly 50' includes an intake manifold 52' and a crossover 54'. Preferably, the manifold 52' includes a first opening 68' and a second opening (not shown but generally similar to the first opening 68'), extending through the manifold 52' from the upper surface to the lower surface of the manifold 52'. The first opening 68' preferably has a substantially C-shaped cross section and defines a first inner surface 72'. Preferably, a rail 90 extends outwardly from the first inner surface 72' of the manifold 52'. Although only the first inner surface 72' of the manifold 52' is illustrated, it will be appreciated that the second opening of the manifold 52' comprises substantially the same features as the first opening 68'.

Fluid sealing means, such as an O-ring or a gasket (not shown), is disposed in a seal recess 96 provided in a passage 58' of the crossover 54' to prevent fluid from leaking between a first end 60' of the crossover 54' and the cylinder head (not shown in FIG. 8). The first end 60' of the crossover 54' includes a groove 92 for slidably receiving the rail 90 of the manifold 52'. Although not illustrated, it will be appreciated that the manifold 52' can include a groove for slidably receiving a rail of the crossover.

Preferably, the crossover 54' is slidably mounted to the manifold 52'. If desired, the first end 60' of the crossover 54' can be retained within the first opening 68' by any desired method, such as by welding, or with glue or other adhesive. The first end 60' of the crossover 54' can be retained within the first opening 68' by an attachment member 94 fastened to the manifold 52' with any desired fastening means, such as threaded fasteners (not shown). As best shown in FIG. 8, the first end 60' of the crossover 54' completely covers the first inner surface 72' of the first opening 68'.

One advantage of the assembly 50, 50' of the invention is that fluid can be conducted through the passage 58, 58' of the crossover 54, 54', such that the coolant does not contact any portion of the manifold 52, 52' at a joint or connection therewith. As noted above in regards to the prior art assembly 10, such coolant can react chemically with the polymer material of the manifold 52, 52' such that the polymer material of the manifold is caused to dissolve, thereby degrading performance of the vehicular cooling system. In contrast to the prior art assembly 10 illustrated in FIGS. 1 through 3, the assembly 50, 50' allows fluid to flow through the crossover 54, 54' between the ends of the manifold 52, 52' without contacting any portion of the manifold 52, 52'. Polymer dissolution which can occur when known engine coolants contact the intake manifold material is thereby prevented.

Another advantage of the coolant crossover and intake manifold assembly 50, 50' is that the assembly is preferably "overmolded" as described above. By overmolding the assembly 50, 50', a plurality of fasteners are eliminated from the assembly 50, 50' compared to the prior art assembly 10.

Another advantage of the overmolded assembly 50, 50' is that at least one pair of gaskets is eliminated from the assembly 50, 50' compared to the prior art assembly 10. As shown in FIGS. 5 and 5A, only one gasket is required at each end of the crossover 54, 54' to prevent fluid from leaking between the assembly 50, 50' and the cylinder head 12A.

In addition to the advantages above, another advantage of the assembly 50' illustrated in FIGS. 7 and 8 is the slidably mounted crossover 54'. Such a slidably mounted crossover 54' can be easily and conveniently installed and easily and conveniently removed for service, repair, or replacement.

The principle and mode of operation of this invention have been described in its preferred embodiments. However, it should be noted that this invention may be practiced otherwise than as specifically illustrated and described without departing from its scope.

What is claimed is:

1. A crossover and manifold assembly adapted for conducting a fluid through a vehicle engine, the conduit and manifold assembly comprising:

a crossover having a passage formed therein extending between a first end and a second end thereof; and a manifold joined to the first and second ends of the crossover, the manifold having first and second openings, the first and second openings defining first and second inner surfaces, respectively;

wherein at least one of the first end and the second end of the crossover is disposed within one of the first and the second openings of the manifold such that the at least one of the first end and the second end of the crossover completely covers the one of the first and the second inner surfaces of the one of the first and the second openings thereby preventing fluid from contacting the one of the first and second inner surfaces of the one of the first and second openings of the manifold.

2. The crossover and manifold assembly according to claim 1, wherein the manifold is joined to the crossover by a mechanical bond.

3. The crossover and manifold assembly according to claim 1, wherein the manifold is joined to the crossover by forming a portion of the manifold about a portion of the crossover.

4. The crossover and manifold assembly according to claim 1, wherein the crossover is joined to the manifold by overmolding a portion of the manifold about a portion of the crossover.

5. The crossover and manifold assembly according to claim 1, wherein both of the first end and the second end of the crossover are disposed within the first and the second openings of the manifold such that both of the first end and the second end of the crossover completely cover the first and the second inner surfaces of the first and the second openings.

6. The crossover and manifold assembly according to claim 1, wherein the crossover is permanently joined to the manifold.

7. The crossover and manifold assembly according to claim 1, wherein the crossover is non-permanently joined to the manifold.

8. The crossover and manifold assembly according to claim 7, wherein the one of the first end and the second end of crossover includes one of a rail and a groove, and the one of the first and the second openings within which the one of the first and second ends is disposed includes the other one of the rail and the groove whereby the crossover is joined to the manifold by slidably moving at least one of the crossover and the manifold with respect to each other.

9. The crossover and manifold assembly according to claim 1, wherein the crossover and the manifold are formed from different materials.

10. The crossover and manifold assembly according to claim 9, wherein the crossover is formed from a metal material and the manifold is formed from a non-metal material.

11. The crossover and manifold assembly according to claim 1, wherein the crossover and the manifold are formed from similar materials.

12. A crossover and manifold assembly adapted for use in a vehicle engine comprising:

a crossover formed from a metal material and having a passage formed therein extending between a first end and a second end thereof; and a manifold formed from a non-metal material and joined to the first and second ends of the crossover, the manifold having first and second openings, the first and second openings defining first and second inner surfaces, respectively;

wherein the first end and the second end of the crossover is disposed within the first and the second openings, respectively, of the manifold such that the first end and the second end of the crossover completely covers the respective first and the second inner surfaces of the first and the second openings thereby preventing fluid from contacting the first and second inner surfaces of the first and second openings of the manifold.

13. The crossover and manifold assembly according to claim 12, wherein the manifold is joined to the crossover by a mechanical bond.

14. The crossover and manifold assembly according to claim 12, wherein the crossover is joined to the manifold by overmolding a portion of the manifold about a portion of the crossover.

15. The crossover and manifold assembly according to claim 12, wherein the crossover is permanently joined to the manifold.

16. The crossover and manifold assembly according to claim 12, wherein the crossover is non-permanently joined to the manifold.

17. The crossover and manifold assembly according to claim 16, wherein the first end and the second end of crossover includes one of a rail and a groove, and the first and the second openings within which the first and second ends are disposed includes the other one of the rail and the groove whereby the crossover is joined to the manifold by slidably moving at least one of the crossover and the manifold with respect to each other.

18. A method of manufacturing a crossover and manifold assembly for conducting a fluid through a vehicle engine, the method comprising the steps of:

a. providing a crossover having a passage formed therein extending between a first end and a second end thereof;

b. providing a manifold having first and second openings, the first and second openings defining first and second inner surfaces, respectively; and c. joining the manifold to the first and second ends of the crossover, wherein at least one of the first end and the second end of the crossover is disposed within one of the first and the second openings of the manifold such that the at least one of the first end and the second end of the crossover completely covers the one of the first and the second inner surfaces of the one of the first and the second openings thereby preventing fluid from contacting the one of the first and second inner surfaces of the one of the first and second openings of the manifold.

19. The method according to claim 18, wherein step (c) includes joining the manifold to the first and second ends of the crossover by forming the manifold about a portion of the crossover.

20. The method according to claim 18, wherein step (c) includes joining the manifold to the first and second ends of the crossover by mechanically bonding the manifold the crossover.

21. The method according to claim 18, wherein step (c) includes joining the manifold to the first and second ends of the crossover by overmolding a portion of the manifold about a portion of the crossover.

22. The method according to claim 18, wherein both of the first end and the second end of the crossover are disposed within the first and the second openings of the manifold such that both of the first end and the second end of the crossover completely cover the first and the second inner surfaces of the first and the second openings.

23. The method according to claim 18, wherein in step (c) the crossover is non-permanently joined to the manifold.

24. The method according to claim 23, wherein the one of the first end and the second end of the crossover includes one of a rail and a groove, and the one of the first and the second openings within which the one of the first and second ends are disposed include the other one of the rail and the groove whereby the crossover is joined to the manifold by slidably moving at least one of the crossover and the manifold with respect to each other.

25. The method according to claim 18, wherein in step (c) the crossover is permanently joined to the manifold.

26. The method according to claim 18, wherein the crossover and the manifold are formed from different materials.

27. The method according to claim 18, wherein the crossover is formed from a metal material and the manifold is formed from a non-metal material.

28. The method according to claim 18, wherein the crossover and the manifold are formed from similar materials.

* * * * *